US005553369A

United States Patent [19]

Shimizu et al.

[11] Patent Number: 5,553,369

[45] Date of Patent: Sep. 10, 1996

[54] METHOD FOR PRODUCING AN ENGINE VALVE

[75] Inventors: Takao Shimizu; Noboru Yamamoto; Hiroaki Suzuki, all of Nagoya, Japan

[73] Assignee: Daido Tokushuko Kabushiki Kaisha, Nagoya, Japan

[21] Appl. No.: 292,961

[22] Filed: Aug. 22, 1994

Related U.S. Application Data

[62] Division of Ser. No. 9,147, Jan. 26, 1993, Pat. No. 5,370, 092.

[30] Foreign Application Priority Data

Jan. 29, 1992 [JP] Japan ..... 4-014148

[51] Int. Cl.[6] ..... B23P 15/00

[52] U.S. Cl. ..... 29/888.46; 29/888.4

[58] Field of Search ..... 29/888.46, 428, 29/888.4; 123/188.3, 188.11

[56] References Cited

U.S. PATENT DOCUMENTS

| | | | |
|---|---|---|---|
| 1,842,110 | 1/1932 | Osterholm | 29/888.43 |
| 2,207,535 | 7/1940 | Corlett | 29/888.43 |
| 4,122,817 | 10/1978 | Matlock . | |
| 4,359,022 | 11/1982 | Nakamura et al. . | |
| 4,366,785 | 1/1983 | Goloff et al. | 29/888.43 |
| 4,597,116 | 9/1989 | de Freitas Couto Rosa et al. . | |
| 4,834,036 | 5/1989 | Nishiyama . | |
| 4,852,531 | 8/1989 | Abkowitz . | |
| 5,076,866 | 12/1991 | Koike et al. . | |
| 5,112,415 | 5/1992 | Mae . | |
| 5,169,460 | 12/1992 | Mae . | |
| 5,184,583 | 2/1993 | Grell | 29/888.43 |
| 5,430,934 | 7/1995 | Groh et al. | 29/888.46 |

FOREIGN PATENT DOCUMENTS

| | | |
|---|---|---|
| 0229907 | 2/1986 | Japan . |
| 0047278 | 4/1990 | Japan . |

*Primary Examiner*—Irene Cuda

*Attorney, Agent, or Firm*—Sughrue, Mion, Zinn, Macpeak & Seas

[57] ABSTRACT

A engine valve having composite structure including a valve stem and a valve head which are made from Ti—Al based alloy and a tail end formed with heat resisting steel are produced by joining a stem end member made from the heat resisting steel to an end of the valve stem made from the Ti—Al based alloy opposite to the valve head by, for example, brazing.

4 Claims, 3 Drawing Sheets

METHOD FOR PRODUCING AN ENGINE VALVE

This is a divisional of application Ser. No. 08/009,147 filed Jan. 26, 1993, now U.S. Pat. No. 5,370,092.

BACKGROUND OF THE INVENTION

1. Field of the Invention

This invention relates to an engine valve and a method for producing the engine valve used as an exhaust valve and an inlet valve of an automotive engine.

2. Description of the Prior Art

The exhaust valve and the inlet valve of the engine for automobiles are required to be excellent in corrosion resistance and oxidation resistance, to say nothing of high temperature strength, and further required to have excellent abrasion resistance at the positions to be in contact with a valve seat, a valve guide and a push rod.

Recently, demands become strong for increasing rotational speed and generating power of the engine and for improving efficiency and fuel comsumption of the automotive engine, and lightening and further improvement of the heat resistance are requested earnestly concerning the engine valve.

Heretofore, Ni-alloyed heat resisting steel and Ni-based heat resisting steel have been used as materials for the engine valve and a method of making the valve stem hollow in core has been introduced in order to reduce the weight of the engine valve, but it is not possible to say that the demand for lightening is satisfied sufficiently.

On the other side, Ti-based alloys are tried to be used as lightweight materials and put into practice in some engines. Although Ti-based alloys are applicable as materials for the inlet valve, it is not suitable to use as materials for the exhaust valve of high powered engine since Ti-based alloys are merely proof against high temperature up to about 500° C.

Accordingly, in recent years, intermetallic compound materials, which are lightweight and excellent in the strength at high temperature, are tested to be used as material for valve motion-related members of the engine such as the engine valve.

Among them, application of Ti-Al based alloy including intermetallic compound is disclosed as materials for the valve in Japanese Patent disclosure Kokai) No. 61-229907/86 and No. 2-47278/90, for example. The engine valve made of Ti—Al based alloy of this kind has a shape as shown in FIG. 5, for example.

An engine valve 51 shown in FIG. 5 is made of Ti—Al based alloy and provided with a valve head 53 at an end of a valve stem 52, the velve head 53 has a head face 53*a*, a valve face 53*b* and head back 53*c*, and the valve stem 52 has a groove 54 and a tail end 55 at the opposite end thereof.

However, in the conventional engine valve 51 formed from Ti—Al based alloy, there is a problem in that the abrasion resistance of the engine valve 51 is unsatistactory at the tail end 55.

SUMMARY OF THE INVENTION

This invention is made in the light of the aforementioned problem of the prior art, and it is an object of the invention to provide an engine valve which is lighweight and excellent not only in the heat resistance but also in the abrasion resistance at the tail end.

The construction of the engine valve according to this invention for attaining the aforementioned object is characterized in that a valve stem and a valve head of the engine valve are made from Ti—Al based alloy (including a case of containing the intermetallic compound partially or entirely) and only a tail end of the valve stem is made from heat resisting steel. The engine valve is characterized in that the valve stem is joined with a stem end member made from heat resisting steel at an end of the valve stem opposite to the valve head in a aspect of the engine valve according to this invention, and characterized in that Ni-based brazing metal lie between the stem end member and the end of the valve stem in the other aspect of the engine valve according to this invention. Furthermore, in another aspect of the engine valve according to this invention, the engine valve characterized in that the Ti—Al based alloy consists by weight percentage of 32 to 36% of Al, 0.1 to 2.0% of Si, 0.1 to 5.0% of Nb, 0.1 to 3.0% of Cr and the balance being substantially Ti.

The construction of the method for producing the engine valve for attaining the aforementioned object is characterized by comprising the steps of forming a valve stem and a valve head in an integrated one body from Ti—Al based alloy (including a case of containing the intermetallic compound partially or entirely) and joining a stem end member made from heat resisting steel at an end of the valve stem opposite to the valve head. The method for producing the engine valve is characterized in that the stem end member is joined at the end of the valve stem by brazing with Ni-based brazing filler metal in an aspect of the method according to this invention, and characterized in that the brazing is carried out at a temperature higher than liquidus line temperature of the Ni-based brazing filler metal by a range of 0°–100° C. in the other aspect of the method according to this invention. Furthermore, in another aspect of the method for producing the engine valve according to this invention, the method is characterized in that the brazing is carried out while applying pressure higher than 0.05 kgf/mm2 and not exceeding yield points of the valve stem and the stem end member at a joining temperature on a joining face between the valve stem and the stem end member.

DESCRIPTION OF THE PREFERRED EMBODIMENT

Figure 1:
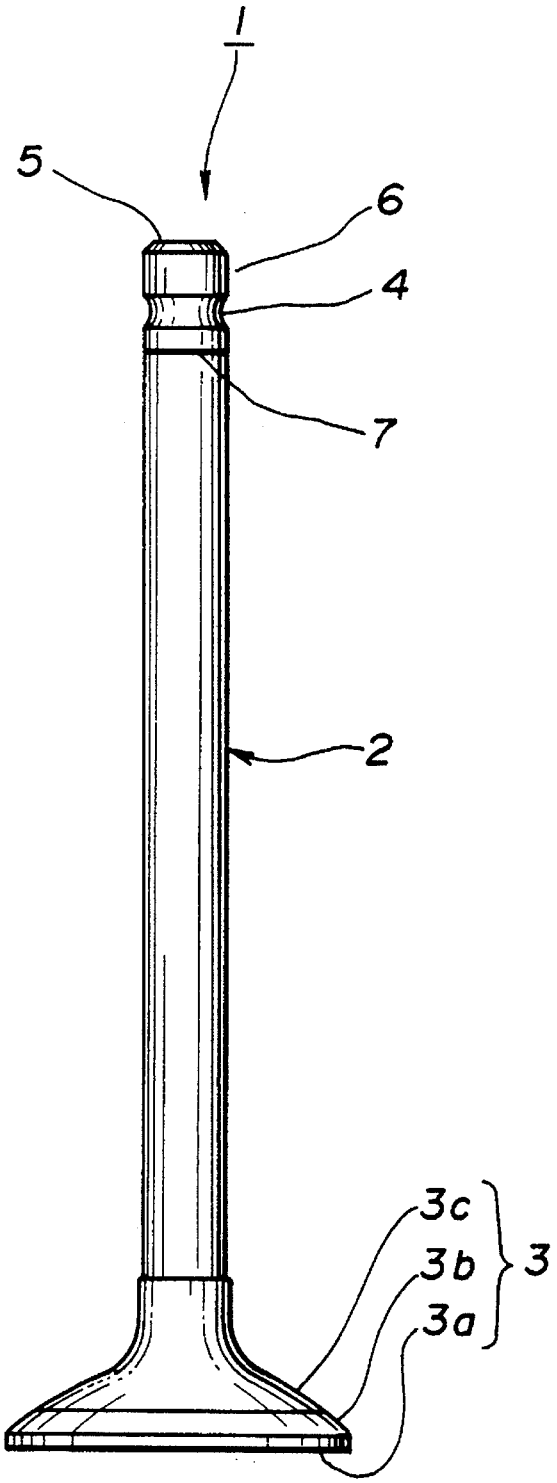
FIG. 1 a front elevation illustrating the engine valve according to an embodiment of this invention.
Figure 2:
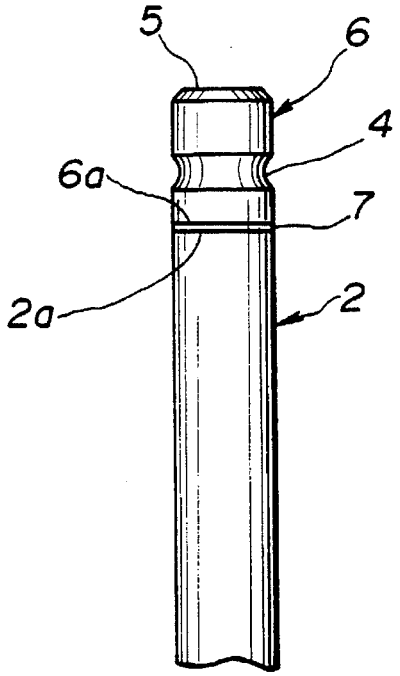
FIG. 2 is an enlarged partial front elevation illustrating the joining point between the valve stem and the stem end member of the engine valve shown in FIG. 1.

FIG. 1 and FIG. 2 show an embodiment of the engine valve according to this invention, an engine valve 1 shown in FIG. 1 and 2 is so structured that a valve stem 2 is provided with a valve head 3 at one end thereof, the valve head 3 has a head face 3*a*, a valve face 3*b* and head back 3*c*, and the valve stem 2 is provided with a groove 4 and a tail end 5 at the opposite end thereof. The valve stem 2 and the valve head 3 are made from Ti—Al based alloy, and the tail end 5 is made from heat resisting steel.

In this case, a stem end member 6 made from heat resisting steel and formed with the groove 4 (may be formed after joining according to circumstances) joined to an end 2*a* of the valve stem 2 opposite to the valve head 3 at an end 6*a* thereof so as to from the tail end 5 from the heat resisting steel, and a brazing metal 7 lies between the end 2*a* of the valve stem 2 and the end 6*a* of the stem end member 6.

In the engine valve 1 having the aforementioned structure, Ti—Al based alloy may be used as a material for the valve stem 2 and the valve head 3, which consists by weight percentage of 32 to 36% of Al, 0.1 to 2.0% of Si, 0.1 to 5.0% of Nb, 0.1 to 3.0% of Cr and the balance being substantially Ti.

The reason for using the Ti—Al based alloy having the aforementioned chemical composition will be described below.

Al:32 to 36%

Al is an indespensable element for forming intermetallic compounds TiAl and $Ti_3Al$ together with Ti, it is preferable to contain Al in a range of 32 to 36% in order to obtain high strength and high ductility in the Ti—Al based alloy of this kind, because $Ti_3Al$ is formed too much and the oxidation resistance is degraded in addition to deterioration of the ductility and the toughness of the alloy when the Al content is too poor, and $Al_3Ti$ is formed in large quantities and the ductility and the toughness are degraded when the Al is contained too much in the alloy coatrally to above.

Si:0.1 to 2.0%

Si is an element effective to further improve the oxidation resistance of the alloy by addition together with Nb as compared with a case of adding Nb in single. However, if Si is contained too much, silicon conpounds are formed in abundance and the ductility and the toughness at room temperature are deteriorated, therefore it is preferable to contain Si in a range of 0.1 to 2.0%

Nb:0.1 to 5.0%

Nb is an element effective to further improve the oxidation resistance of the alloy by coexistence with Si as compared with a case of adding Si in single, and the oxidation resistance is improved in proportion to the increase of the Nb content. Although, Nb is effective to improve the strength of $Ti_3Al$ by dissolving in $Ti_3Al$ more than in TiAl, the effect of Nb is saturated and the ductility is rather degraded even if Nb is contained too much, therefore it is preferable to contain Nb in a range of 0.1 to 5.0%.

Cr:0.1–3.0%

Cr is an element disolvable in both TiAl and $Ti_3Al$, especially in $Ti_3Al$ abundantly. The strength of the alloy is improved according to solution hardening by dissolving Cr in TiAl, thereby improving creep rupture strength. The effect of Cr is shown when the Cr content is not less than 0.1% or so, but the effect is saturated and the oxidation resistance is rather degraded in addition to the deterioration of the ductility when the Cr content is too large, therefore it is preferable to contain Cr in a range of 0.1 to 3.0%.

Ti:Balance

Ti balanced with the elements described above is an indispensable element for forming TiAl and $Ti_3Al$ in the TiAl—$Ti_3Al$ duplex alloy.

The above-mentioned Ti—Al based alloy is obtained by melting base alloys through a plasma arc melting process, an argon arc melting process, a vacuum arc melting process and so on.

The Ti—Al based alloy to be used for the material of the valve stem 2 and the valve head 3 of the engine valve according to this invention is a material lightweight and excellent in the creep strength and the strength at elevated temperature, and have single or duplex structure of $Ti_3Al$ and TiAl denoted by chemical symbols, fundamentally.

In this case, it is desirable to use Ti—Al—Si—Nb—Cr alloy which is excellent in the oxidation resistance and the ductility considering scaling off from the surface layer of the valve while the valve is in being operated, and further preferable to use the alloy having the chemical composition as described above.

The Ti—Al based alloy molten through the melting process exemplified above is formed in the shape of the engine valve 1 having the valve stem 2 and the valve head 3 by a precision casting method, a high temperature forging method after casting the molten alloy into an ingot, or by molding and sintering powder made from the molton alloy through a powder metallurgical process.

On the other side, heat resisting steel is applied as a material for the stem end member 6 and the heat resisting steel may be used which consists by weight percentage of 0.35 to 0.85% of C., 1.0 to 3.5% of not more than 10% of Mn and 3.5 to 27% or Cr, and if necessary one or both of not more than 37% of Ni and not more than 3.5% of Mo, and the balance being substantially Fe, for example.

In this case, C is an element effective to increase the strength of the tail end of the valve stem and may be contained not less than 0.35%, but should be limited to not more than 0.85% since the corrosion resistance and the toughness are degraded if C is added in excess. Si is effective as a deoxidizer and may be contained not less than 1.0%, however it is preferable to limit the Si content to not more than 3.5% since the toughness and the machinability is deteriorated by excessive addition of C. Mn acts as a deoxidizer and a desulfurizer and is effective to improve the heat resistance, should be contained in a range not exceeding 10% since the workability is degraded if Mn is contained in excess. Cr is effective to improve the corrosion resistance and may be contained not less than 7.5%, but should be limited to not more than 27% for the reason that the strength decreases by the action of excessive Gr. Furthermore, it is preferable to contain Ni in a range not exceeding 37% for improving the corrosion resistance, and also preferable to contain Mo so as not to exceed 3.5% for improving the strength at elevated temperature.

The stem end member 6 formed from heat resisting steel is joined to the end 2*a* of the valve stem 2 and the valve head 3 formed with Ti—Al based alloy at the end 6*a* thereof, and pressure welding process, brazing or the like is applicable as a joining method in this case.

In a case of brazing, a following method may be introduced, for example.

Figure 3:
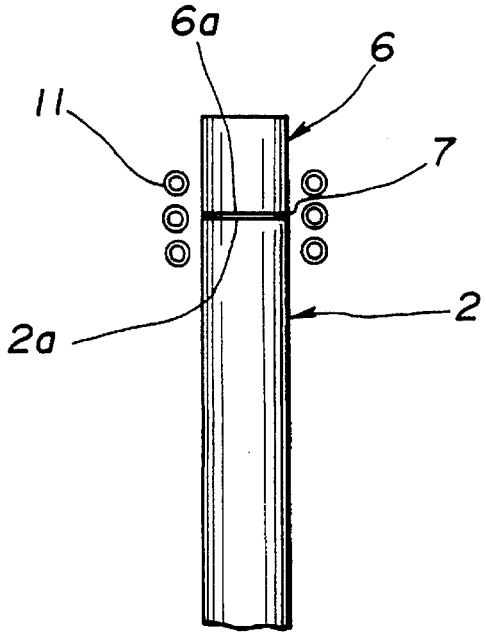
FIG. 3 is a schematic view illustrating an example of the method for producing the engine valve according to an embodiment of this invention.
Figure 4:
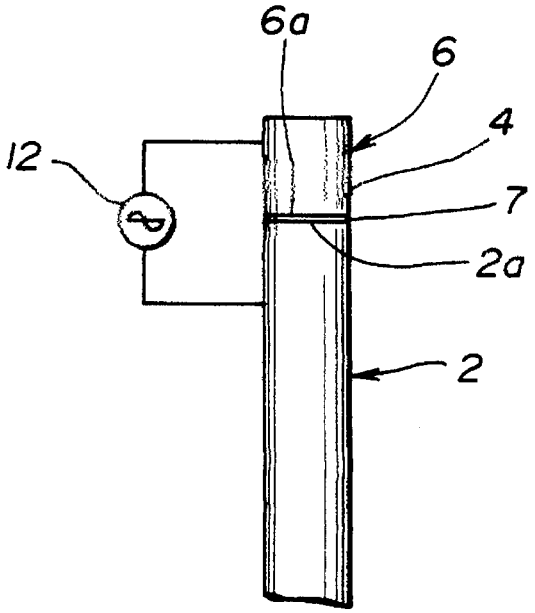
FIG. 4 is an schematic view illustrating another example of the method for producing the engine valve according to an embodibodiment of this invention.

Namely, the brazing metal 7 is placed between the end 2*a* of the valve stem 2 made from Ti—A1 based alloy and the end 6*a* of the stem end member 6 made from heat resisting steel by thermal spraying on the end 2*a* or 6*a* with brazing filler metal or putting the foliated brazing filler metal between the ends 2*a* and 6*a* as shown in FIG. 3, and the ends 2*a* and 6*a* are brazed by heating and melting the brazing metal 7 by induction heating using an induction coil 11. In this case, the brazing may be carried out by heating and melting the brazing metal 7 by resistance heating caused by an electric power source 12 connected between the ends 2*a* and 6*a* as shown in FIG. 4 instead off the induction coil 11 shown in FIG. 3.

Furthermore, it is preferable to carry out brazing using Ni-Based filler metal, and further preferable to braze at a temperature higher than liquidus line temperature of the Ni-based brazing filler metal by a range of 0°–100° C. In this case, strength at the joining point shows a tendency to decrease if the brazing is carried out at a temperature higher than liquidus line temperature by 100° C. or more.

Addition to above, it is desirable to braze the valve stem 2 and the stem end member 6 while applying pressure higher than 0.05 kgf/mm2 and not exceeding yield points of the valve stem 2 and the stem end member 6 at a joining temperature on a joining face between the valve stem 2 and the stem end member 6. In this case, if the applied pressure is lower than 0.05 kgf/mm2, the brazing strength shows a tendency to be degraded.

In the engine valve 1 according to this invention, overlaying, which is also performed in the conventional engine valve, may be carried out by plasma powder welding (P.P.W), laser welding or so on the valve face **3*b* of the valve head 3** requied for excellent abrasion resistance against the valve seat of the engine.

The Ti—Al based alloy forming the valve stem 2 and the valve head 3 has specific gravity of approximately 3.8 g/cm3, which is equal to about 50% of that of the conventional steel-made valve. Accordingly, the engine valve can be made lighter drastically and it is possible to improve the valve action smoothly and nimbly in consequence of reduction of the friction and the inertial weight of the valve.

EXAMPLE 1

The valve stem 2 and the valve head 3 of the engine valve 1 were formed from Ti—Al based alloy consisting by weight percentage of 33% of Al, 0.6% of Si, 1.0% of Nb, 0.5% of Cr and balanced Ti, and the stem end member 6 was formed into a shape not having the groove 4 from heat resisting steel consisting by weigh percentage of 0.51% of C., 1.49% of Si, 0.31% of. Mn, 8.21% of Cr and balanced Fe. Subsequently, the inventive engine valve 1 having the valve stem 2 and the valve head 3 made from the Ti—Al based alloy and the tail end 5 made from the heat resisting steel is produced by brazing the stem end member 6 to the end **2*a* of the valve stem 2 using Ni-based brazing filler metal (BNi-3 ) specified by AWS (American Welding Society) A5.8-81, at a temperasare of 1100° C. while applying a pressure of 0.3 kgf/mm2 on the joining face between the valve stem 2 and the stem end member 6**.

Figure 5:
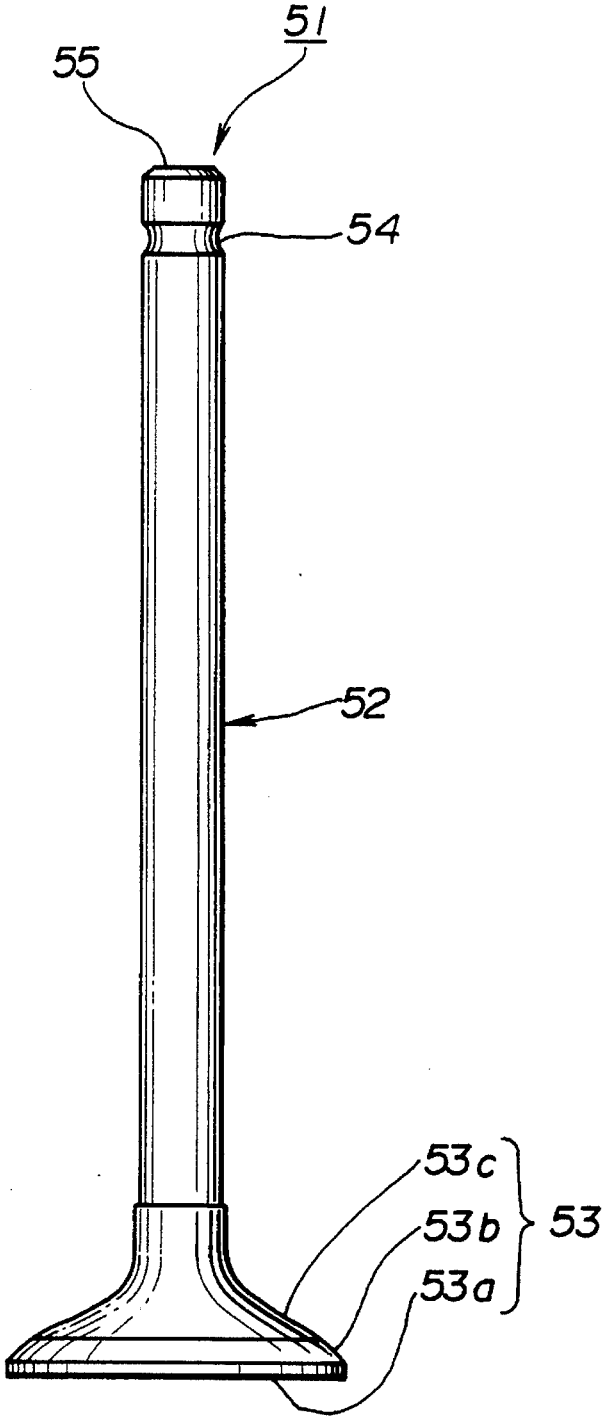
FIG.5 (PRIOR ART)
FIG. 5 is a front elevation of the conventional engine valve made of Ti—Al based alloy.

Furthermore, the comparative engine valve 51 was made by forming into the shape having the valve stem 52, the valve head 53, the groove 54 and the tail end 55 from the aforementioned Ti—Al based alloy as shown in FIG. 5.

Then, the engine valve 1 and 51 were mounted on the practical engine as exhaust valves, and abrasion loss in the exhaust gass of 900° C. was measured respectively at end faces of the tail ends 5 and 55. The obtained results are shown in Table 1.

TABLE 1

| Material for tail end of engine valve | Hardness on end face of tail end ($H_RC$) | Abrasion loss at end face of tail end (mm) 100 h | 500 h |
|---|---|---|---|
| Heat resisting steel | 63 | <0.01 | 0.02 |
| Ti-Al based alloy | 27 | 0.12 | 0.73 |

As apparently from the results shown in Table 1, it was comfirmed that the abrasion loss was remarkably low in a case of inventive engine valve 1 having the tail end 5 made from the heat resisting steel, and the abrasion resistance was improved considerably as compared with a case of comparative engine valve 51 of which tail end 55 was made from the Ti—Al based alloy.

EXAMPLE 2

The valve stem 2, the valve head 3 and the stem end member 6 were manufactured from the aforementioned Ti—Al based alloy and the heat resisting steel, respectively, in the same manner as Example 1, and the engine valve 1 was made by brazing the stem end member 6 to the end **2*a* of the valve stem 2 similarly to the above using one of brazing filler metals different in kind from each other. Subsequently, braking load and breaking point of the engine valve 1** were inspected by a tensile test. The obtained results are shown in Table 2

TABLE 2

| Kind of brazing filler metal | Melting point of brazing filler metal (°C.) | Breaking load (kgf) | Breaking point |
|---|---|---|---|
| BAg-8 (72Ag-28Cu) | 730 | 620 | Joined face |
| BCuZn-4 (51Cu-49Zn) | 875 | 510 | Joined face |
| BA4004 (10Si-1.5Mg—Al) | 591 | 205 | Joined face |
| BNi-1 (14Cr-3B-4.5Si-4.5Fe—Ni) | 1040 | 980 | Ti-Al based alloy |
| BNi-2 (7Cr-3B-4.5Si 3Fe—Ni) | 1000 | 990 | Ti-Al based alloy |
| BNi-3 (3B-4.5Si—Ni) | 1040 | 990 | Ti-Al based alloy |
| BNi-6 (11P—Ni) | 875 | 990 | Ti-Al based alloy |

As apparent from Table 2, it was confirmed that the engine valve 1 was raputured at the Ti—Al based alloy (base metal) and the brazing strength becomes higher in a case where the engine valve 1 was brazed using the Ni-based brazing filler metal (BNi-1, BNi-2, BNi-3 and BNi-6).

EXAMPLE 3

In the case of making the engine valve 1 by brazing the stem end member 6 and the valve stem 2 in the same manner as the above, the brazing was carried out using the Ni-based brazing filler metals (BNi-3 and BNi-2) at respective brazing temperature as shown in Table 3, and the breaking load and the breaking point of the engine valve 1 were inspected by the tensile test. The obtained results are also shown in Table 3.

TABLE 3

| Kind of brazing filler metal | Melting point of brazing filler metal (°C.) | Brazing Temperature (°C.) | Breaking load (kgf) | Breaking point |
|---|---|---|---|---|
| BNi-3 | 1040 | 1080 | 990 | Ti-Al based alloy |
| BNi-3 | 1040 | 1100 | 990 | Ti-Al based alloy |
| BNi-3 | 1040 | 1140 | 980 | Ti-Al based alloy |
| BNi-3 | 1040 | 1150 | 900 | Joined face including Ti-Al based alloy |
| BNi-2 | 1000 | 1050 | 980 | Ti-Al based alloy |

TABLE 3-continued

| Kind of brazing filler metal | Melting point of brazing filler metal (°C.) | Brazing Temperature (°C.) | Breaking load (kgf) | Breaking point |
|---|---|---|---|---|
| BNi-2 | 1000 | 1080 | 990 | Ti-Al based alloy |
| BNi-2 | 1000 | 1120 | 920 | Joined face including Ti-Al based alloy |
| BNi-2 | 1000 | 1150 | 905 | Joined face including Ti-Al based alloy |

As is apparent from Table 3, the strength of the brazing point increased in the case of brazing the engine valve 1 at a temperature higher than the liquidus line of the brazing filler metal within a range not exceeding 100° C., however the breaking load of the engine valve 1 was degraded when the brazing temperature was higher than the liquidus line temperature of the brazing filler metal in excess of 100° C. It was found that it was desirable to braze the engine valve at a temperature higher than melting point of the brazing filler metal and not higher than the melting point +100° C.

EXAMPLE 4

In the case of making the engine valve 1 by brazing the stem end member 6 and the valve stem 2 in the same manner as the above, the brazing was carried out using the Ni-based brazing filler metal (BNi-3) at a constant brazing temperature while applying respective pressure to the joining face between the stem end member 6 and the valve stem 2, and the brazing was further carried out using the other Ni-based brazing filler metal (BNi-2) under the respective pressure as shown in FIG. 4. Subsequently, the breaking load and the breaking point were inspected by the tensile test. The obtained results are al so shown in Table 4.

TABLE 4

| Kind of brazing filler metal | Melting point of brazing filler metal (°C.) | Brazing temperature (°C.) | Pressure applied to joining face (kgf/mm$^2$) | Breaking load (kgf) | Breaking point |
|---|---|---|---|---|---|
| BNi-3 | 1040 | 1100 | 0.03 | 930 | Joined face including Ti-Al based alloy |
| BNi-3 | 1040 | 1100 | 0.05 | 980 | Ti-Al based alloy |
| BNi-3 | 1040 | 1100 | 0.10 | 990 | Ti-Al based alloy |
| BNi-3 | 1040 | 1100 | 0.50 | 990 | Ti-Al based alloy |
| BNi-2 | 1000 | 1050 | 0.03 | 920 | Joined face including Ti-Al based alloy |
| BNi-2 | 1000 | 1050 | 0.10 | 990 | Ti-Al based alloy |
| BNi-2 | 1000 | 1050 | 0.70 | 990 | Ti-Al based alloy |

As apparent from Table 4, it was possible to obtain the brazing strength sufficiently by applying pressure in some degree to the joining face between the stem end member 6 and the valve stem 2 as compared that it was difficult to obtain sufficient strength if the pressure was too low at the time of brazing. And it was observed that it was preferable to braze under a pressure higher than 0.05 kgf/mm2.

As explained above, the engine valve according to this invention has composite structure comprising tile valve stem and the valve head of the engine valve are made from Ti—Al based alloy which is lightweight and excellent in the creep strength and the strength at elevated temperatures and the tail end of the engine valve is formed with heat resisting steel excellent in the heat resistance and the abrasion resistance. Therefore, it is possible to provide the engine valve which is lightweight and excellent in the heat resistance and the oxidation resistance, especially in the abrasion resistance at the tail end thereof, and an excellent effect can be obtained since it is possible to improve the response of the automotive engine by improving the moving performance of the valve and possible to improve the abrasion resistance at the tail end of the engine valve.

In the method for producing the engine valve according to this invention, the valve stem and the valve head are made from Ti—Al based alloy, and the stem end member made from heat resisting steel is joined the end of the valve stem opposite to the valve head, therefore an excellent effect can be obtained in that it is possible to produce the composite structured engine valve having excellent characteristics as described above.

What is claimed is:

1. A method for producing an engine valve comprising:

forming a valve stem and a valve head in an integrated single body from a Ti—Al based allow; and joining a stem end member made from heat resisting steel at the end away from the valve head by brazing with a Ni-based brazing filler metal.

2. A method for producing an engine valve as set forth in claim 1, wherein said brazing is carried out at a temperature with a range of 0°–100° C. higher than liquidus line temperature of said Ni-based brazing filler metal.

3. A method for producing an engine valve as set forth in claim 1, wherein said brazing is carried out while applying pressure higher than 0.05 kgf/mm$^2$ and not exceeding yield points of said valve stem and said stem end member at a joining temperature to a joining face between the valve stem and the stem end member.

4. A method for producing an engine valve as set forth in claim 2, wherein said brazing is carried out while applying pressure higher than 0.05 kgf/mm$^2$ and not exceeding yield points of said valve stem and said stem end member at a joining temperature to a joining face between the valve stem and the stem end member.

* * * * *